US010865580B1

(12) United States Patent
Elder et al.

(10) Patent No.: US 10,865,580 B1
(45) Date of Patent: Dec. 15, 2020

(54) ARTIFICIALLY-LIGHTED WATERFALL FIXTURE APPARATUS AND ARTIFICIAL LIGHT-FOCUSING MODULE

(71) Applicant: WATER WORKS TECHNOLOGIES GROUP, LLC, Pompano Beach, FL (US)

(72) Inventors: David W. Elder, Cocoa Beach, FL (US); Clynton Doyle, Delray Beach, FL (US); Kevin Doyle, Delray Beach, FL (US)

(73) Assignee: WATER WORKS TECHNOLOGIES GROUP, LLC, Pompano Beach, FL (US)

( * ) Notice: Subject to any disclaimer, the term of this patent is extended or adjusted under 35 U.S.C. 154(b) by 45 days.

(21) Appl. No.: 16/293,049

(22) Filed: Mar. 5, 2019

Related U.S. Application Data

(62) Division of application No. 15/729,222, filed on Oct. 10, 2017, now Pat. No. 10,221,583.

(51) Int. Cl.

| | |
|---|---|
| ***E04H 4/14*** | (2006.01) |
| ***F21V 5/04*** | (2006.01) |
| ***B05B 17/08*** | (2006.01) |
| ***F21V 29/58*** | (2015.01) |
| ***F21V 23/06*** | (2006.01) |

(Continued)

(52) U.S. Cl.
CPC ..... *E04H 4/148* (2013.01); *B05B 17/085* (2013.01); *F21V 5/048* (2013.01); *F21V 17/06* (2013.01); *F21V 19/0055* (2013.01); *F21V 23/06* (2013.01); *F21V 29/59* (2015.01); *F21V 31/005* (2013.01); *F21W 2121/02* (2013.01); *F21Y 2115/10* (2016.08)

(58) Field of Classification Search
CPC ..... E04H 4/148; F21V 29/59; F21V 5/048; F21V 17/06; F21V 19/0055; F21V 23/06; F21V 31/005; B05B 17/085; F21Y 2115/10; F21W 2121/02
See application file for complete search history.

(56) References Cited

U.S. PATENT DOCUMENTS 6,196,471 B1 * 3/2001 Ruthenberg ..... B05B 17/08 239/18
10,221,583 B1 * 3/2019 Elder ..... F21V 17/06
(Continued)

*Primary Examiner* — Mary Ellen Bowman
(74) *Attorney, Agent, or Firm* — Glenn E. Gold, P.A.; Glenn E. Gold

(57) ABSTRACT

An artificially-lighted waterfall fixture apparatus includes a fixture housing having a lower housing part and an upper housing part overlying and fitted with the lower housing part so as to define a water-distributing channel and a passageway extending forwardly from and in communication with the water-distributing channel to receive a flow of water therefrom and produce an artificial waterfall flowing from an outlet of the passageway. The apparatus also includes an elongated baffle disposed in the fixture housing along a top portion of the water-distributing channel to receive and convert the flow of water to a laminar flow through the passageway, and an artificial light-focusing module supported centrally in the fixture housing proximate the water-distributing channel and aligned with the passageway so as to generate a beam of light through the passageway that produces a predetermined configuration of light in the laminar flow of water.

2 Claims, 13 Drawing Sheets

(51) Int. Cl.

| | |
|---|---|
| ***F21V 19/00*** | (2006.01) |
| ***F21V 17/06*** | (2006.01) |
| ***F21V 31/00*** | (2006.01) |
| ***F21Y 115/10*** | (2016.01) |
| ***F21W 121/02*** | (2006.01) |

(56) References Cited

U.S. PATENT DOCUMENTS

2005/0128751 A1* 6/2005 Roberge ..... G06F 3/1446
362/276
2006/0042689 A1* 3/2006 Hinojosa, Jr. ..... E04H 4/14
137/137
2007/0008713 A1* 1/2007 Doyle ..... F21V 23/0407
362/101
2007/0279900 A1* 12/2007 Bauer ..... F21V 29/773
362/158
2016/0263613 A1* 9/2016 Lin ..... F21V 33/00

* cited by examiner

ARTIFICIALLY-LIGHTED WATERFALL FIXTURE APPARATUS AND ARTIFICIAL LIGHT-FOCUSING MODULE

CROSS-REFERENCE TO RELATED APPLICATION(S)

This U.S. non-provisional patent application is a divisional of U.S. patent application Ser. No. 15/729,222, filed 10 Oct. 2017, and issuing 5 Mar. 2019 as U.S. Pat. No. 10,221,583.

FIELD OF THE INVENTION

The present invention relates to lighted devices used with swimming pools or spas and, more particularly, is concerned with an artificially-lighted waterfall fixture apparatus for pools, spas and the like, and an artificial light-focusing module of the waterfall apparatus.

BACKGROUND OF THE INVENTION

Different types of lighted fixtures are currently used in swimming pool and spa settings. One such type of fixture provides an artificial waterfall in which light interacts with flowing water to provide an aesthetically-pleasing effect.

The presence of water and electrically-generated light in close proximity to one another raises issues of how to provide for isolation of water and electrical flows from one another, internal reflection of light in flowing water, dissipation of heat, and component serviceability. Past approaches to accommodating or avoiding some or all of these issues are disclosed in U.S. Pat. Nos. 4,749,126, 6,484,952, 7,384,165, 9,505,018 and U.S. Pat. App. Pub. No. 2010/0195309.

However, it is perceived that there remains a need in the art for an innovation that will overcome any deficiencies of these past approaches and any problems that may still be unsolved.

SUMMARY OF THE INVENTION

The present invention is directed to an innovation providing an artificially-lighted waterfall fixture apparatus and an artificial light-focusing module used therein that overcomes deficiencies of past approaches and problems that remain unsolved.

In one aspect of the present invention, an artificially-lighted waterfall fixture apparatus includes:

- a fixture housing including
  - a lower housing part, and
  - an upper housing part overlying and fitted with the lower housing part so as to define a water-distributing channel and a passageway extending forwardly from, and in communication with, the water-distributing channel to receive a forward flow of water from the water-distributing channel and through the passageway, and to produce an artificial waterfall flowing from an outlet of the passageway;
- an elongated baffle disposed in the fixture housing along a top portion of the water-distributing channel to receive and convert the forward flow of water from the water-distributing channel to a forward laminar flow of water through the passageway; and
- an artificial light-focusing module supported centrally in the fixture housing proximate the water-distributing channel and aligned with the passageway so as to generate a beam of light through the passageway that produces a predetermined configuration of light in conjunction with the forward laminar flow of water through the passageway and the artificial waterfall flowing from the outlet of the passageway.

In another aspect of the present invention, the lower housing part of the fixture housing includes an elongated reservoir defining the water-distributing channel for enabling lateral distribution of water therein, and a bottom panel connected to and extending forwardly from a front portion of the elongated reservoir. The lower housing part also includes an inlet connected to, and in communication with the water-distributing channel of, the elongated reservoir for enabling entry of a continuous supply of water into the water-distributing channel via the inlet.

In another aspect of the present invention, the upper housing part of the fixture housing includes an elongated lid overlying and spaced above the elongated reservoir of the lower housing part, and a top panel connected to and extending forwardly from the elongated lid and overlying the bottom panel of the lower housing part. The top panel of the upper housing part and the bottom panel of the lower housing part, together, define therebetween the passageway extending forwardly from, and in communication with, the water-distributing channel of the elongated reservoir of the lower housing part that produces the artificial waterfall flowing from the outlet of the passageway.

In another aspect of the present invention, an artificially-lighted waterfall fixture apparatus includes:

- a fixture housing including
  - a lower housing part,
  - an upper housing part overlying and fitted with the lower housing part so as to define a water-distributing channel and a passageway extending forwardly from and in communication with the water-distributing channel to receive a forward flow of water from the water-distributing channel into and through the passageway to produce an artificial waterfall flowing from an outlet of the passageway,
  - an annular sleeve extending downwardly from the lower housing part and centrally disposed therealong proximate the water-distributing channel and having a sidewall defining an orifice extending between and open at opposite ends of the annular sleeve, and
  - an annular collar extending upwardly from to the upper housing part and spaced-apart from and above the annular sleeve, the annular collar centrally disposed along the water-distributing channel and having a sidewall defining an opening in vertical alignment with the orifice of the annular sleeve;
- an elongated baffle contained within the fixture housing and seated on the lower housing part along a top portion of the water-distributing channel to receive and convert the forward flow of water from the water-distributing channel to a forward laminar flow of water through the passageway; and
- an artificial light-focusing module supported centrally by fixture housing within the annular collar of the upper housing part and the annular sleeve of the lower housing part and extending within and between the opening of the annular collar and the orifice of the annular sleeve proximate the water-distributing channel and aligned with the passageway so as to generate a beam of light through the passageway that produces a predetermined configuration of light in the forward laminar flow of water through the passageway and the artificial waterfall flowing from the outlet of the passageway, the artificial light-focusing module removable from and replaceable within the opening of the annular collar and the orifice of the annular sleeve in the fixture housing via the annular collar.

In another aspect of the present invention, the artificial light-focusing module includes a light-generating device and a light-focusing optic. The light-generating device is disposed between and spaced from the annular collar of the upper housing part and the annular sleeve of the lower housing part so as to project a light beam outward therefrom forwardly toward the passageway between the upper and lower housing parts. The light-focusing optic overlies the light-generating device and has a semi-annular rounded exterior shape so as to form the light beam in the predetermined configuration.

In another aspect of the present invention, an artificial light-focusing module includes:

a pedestal having a central tubular portion, an upper mounting portion connected on an upper end of the central tubular portion and having a central platform surrounding, and extending above and radially outward from, the upper end of the central tubular portion and an annular rim recessed into the central platform about the periphery thereof, and an upright bracket connected on and upstanding from a rear segment of the central platform and having a front side facing outwardly from the upright bracket;

a circuit board fastened across the front side of the upright bracket;

a light source operatively mounted on the circuit board so as to project a light beam outward therefrom in a predetermined configuration, the central tubular portion of the pedestal having a lower internally threaded end for connection with a cable to supply electrical power to the circuit board; and a tubular enclosure defining a central cavity open at least at a bottom of the tubular enclosure so as to enable placement of the tubular enclosure over the upright bracket and the light source and upon and attachment to the annular rim of the central platform of the upper mounting portion of the pedestal, the tubular enclosure having a front section made of a transparent material so as to enable passage therethrough of the light beam from the light source.

In another aspect of the present invention, the light source include a light-generating device mounted on the circuit board that comprises a light-emitting diode (LED), and a light-focusing optic fastened on the circuit board so as to overlie the light-generating device and that has a semi-annular rounded exterior shape so as to form the light beam in the predetermined configuration.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF EXEMPLARY IMPLEMENTATIONS

Figure 1:
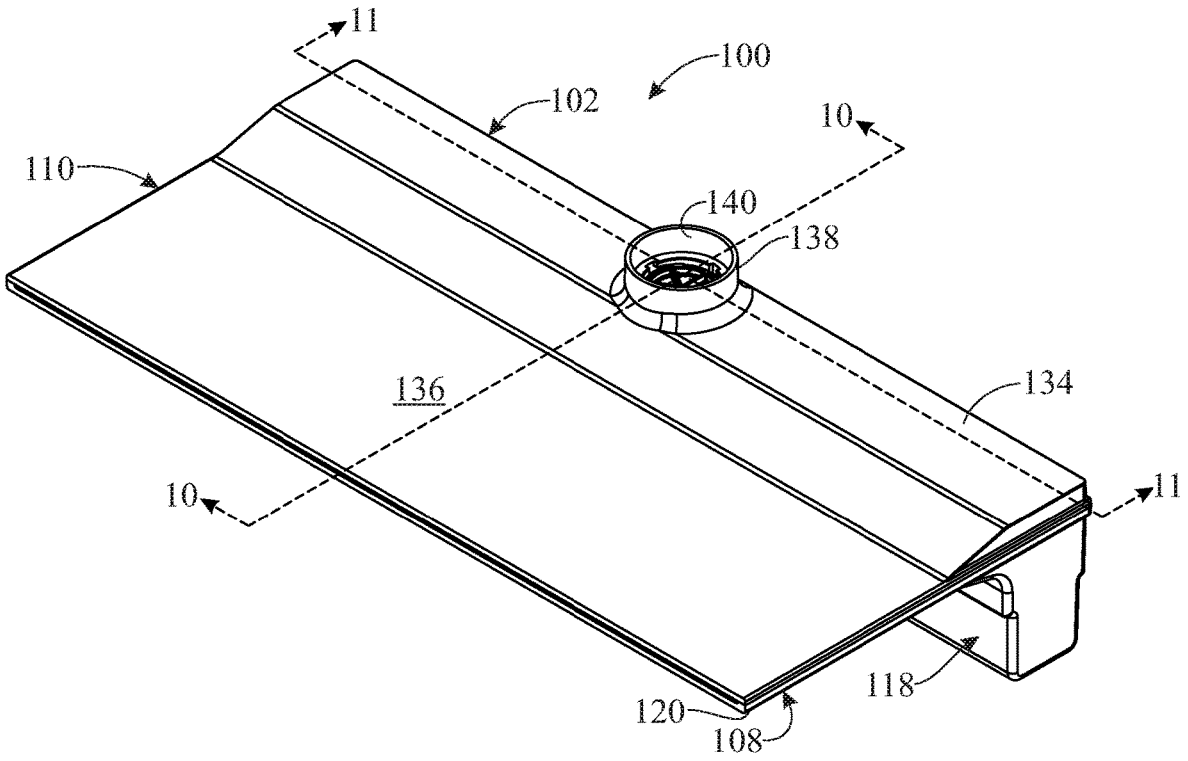
FIG. 1 presents a top front isometric view of an exemplary embodiment of an artificially-lighted waterfall fixture apparatus in accordance with aspects of the present invention.
Figure 2:
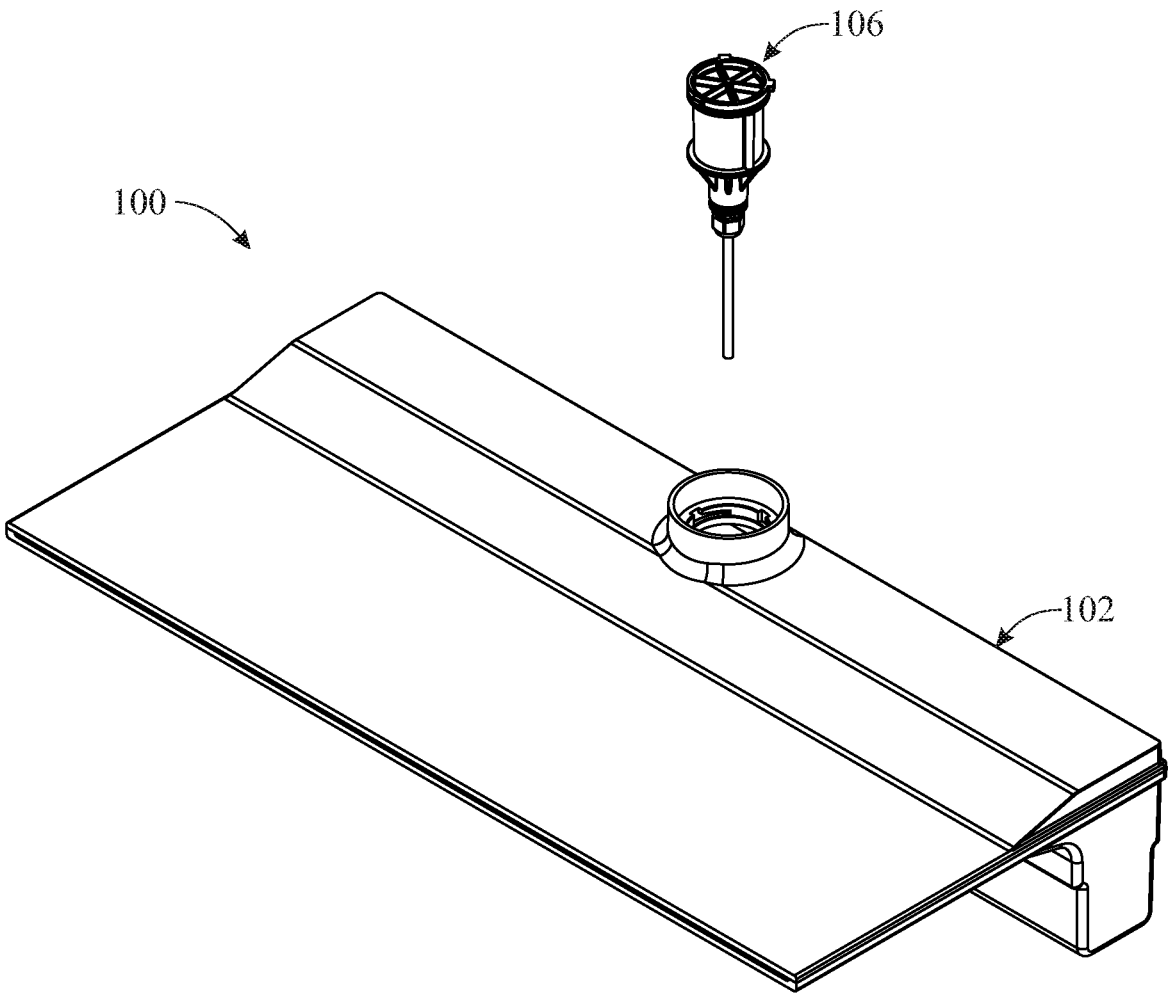
FIG. 2 presents a top front isometric view of the apparatus originally introduced in FIG. 1, illustrating an artificial light-focusing module removed from the waterfall housing of the apparatus.
Figure 3:
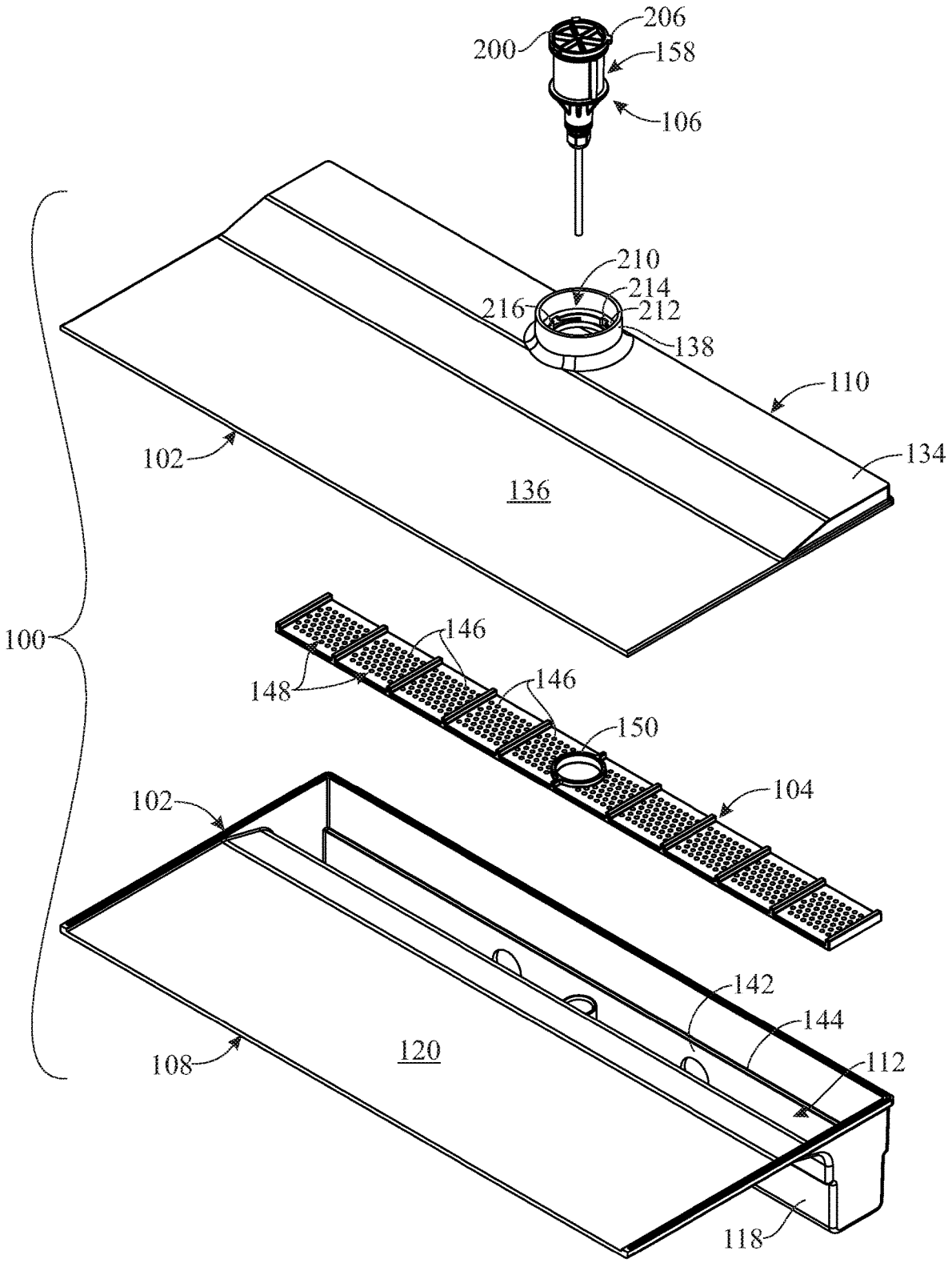
FIG. 3 presents a top front exploded isometric view of the apparatus originally introduced in FIG. 1.
Figure 4:
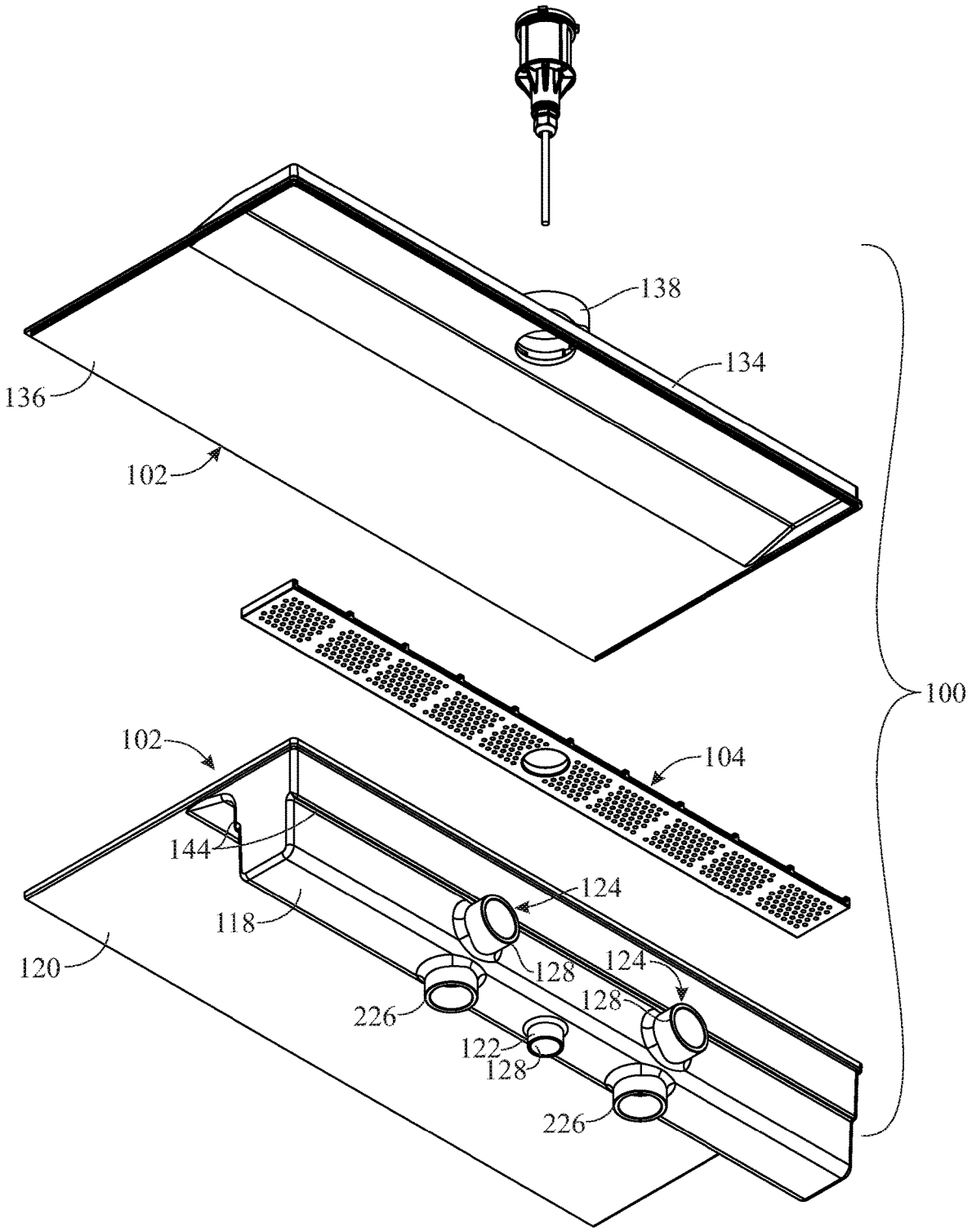
FIG. 4 presents a bottom rear exploded isometric view of the apparatus originally introduced in FIG. 1.
Figure 5:
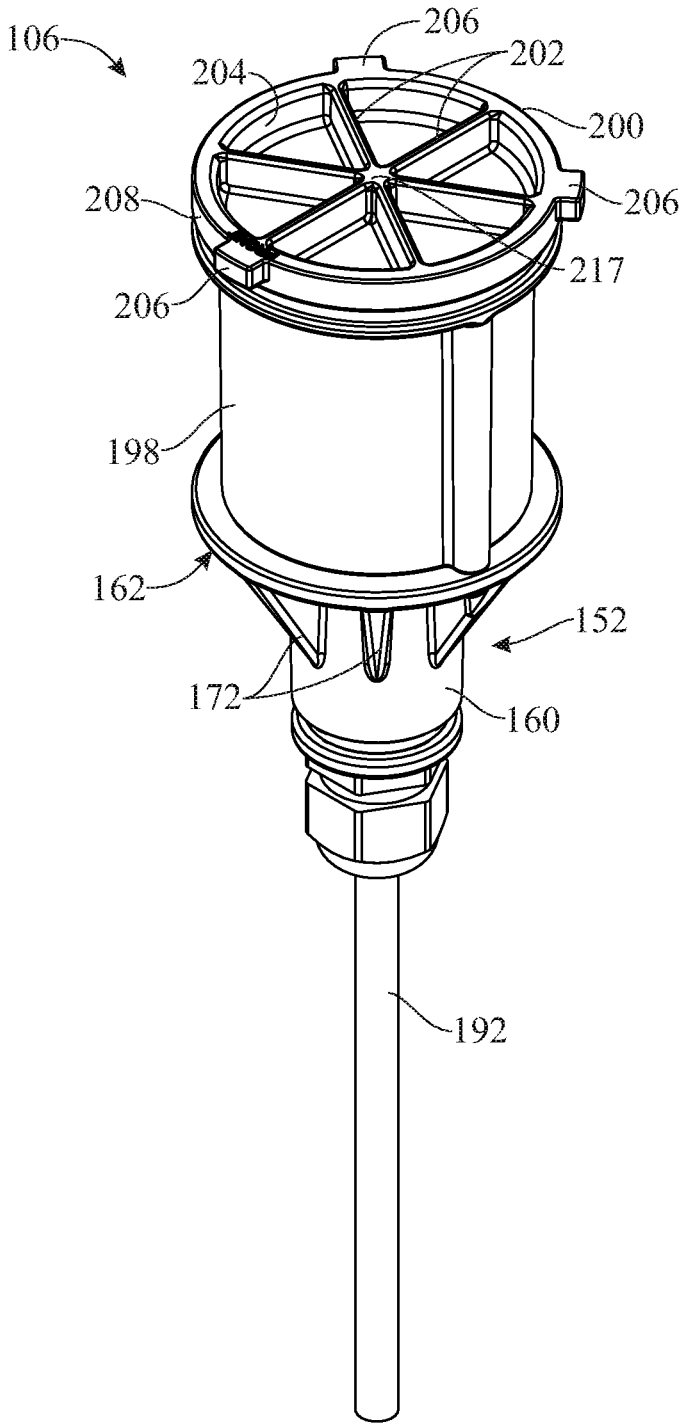
FIG. 5 presents an enlarged top front isometric view of an exemplary embodiment of the artificial light-focusing module in accordance with aspects of the present invention.
Figure 6:
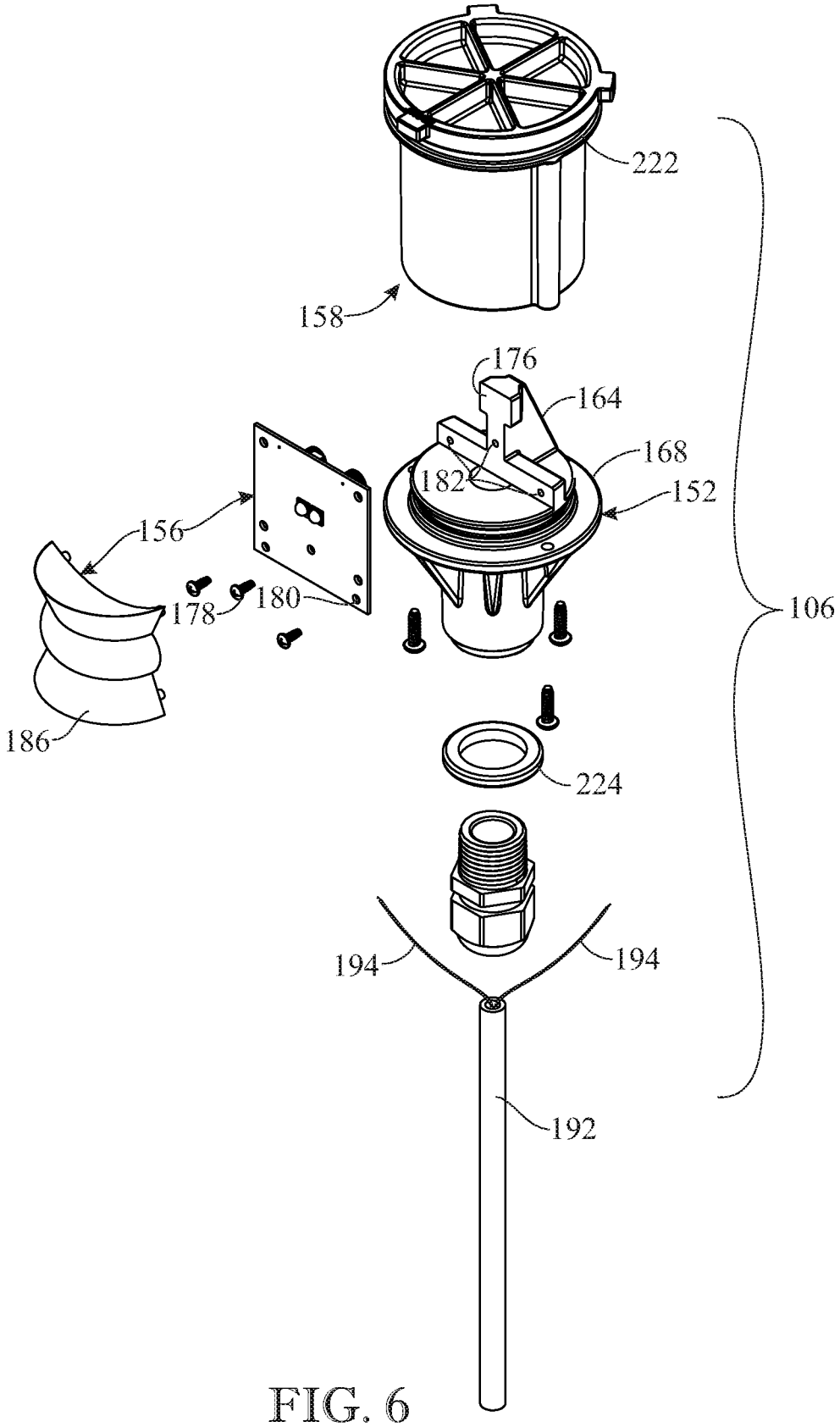
FIG. 6 presents a top front exploded isometric view of the module on a scale reduced from that of FIG. 5.
Figure 7:
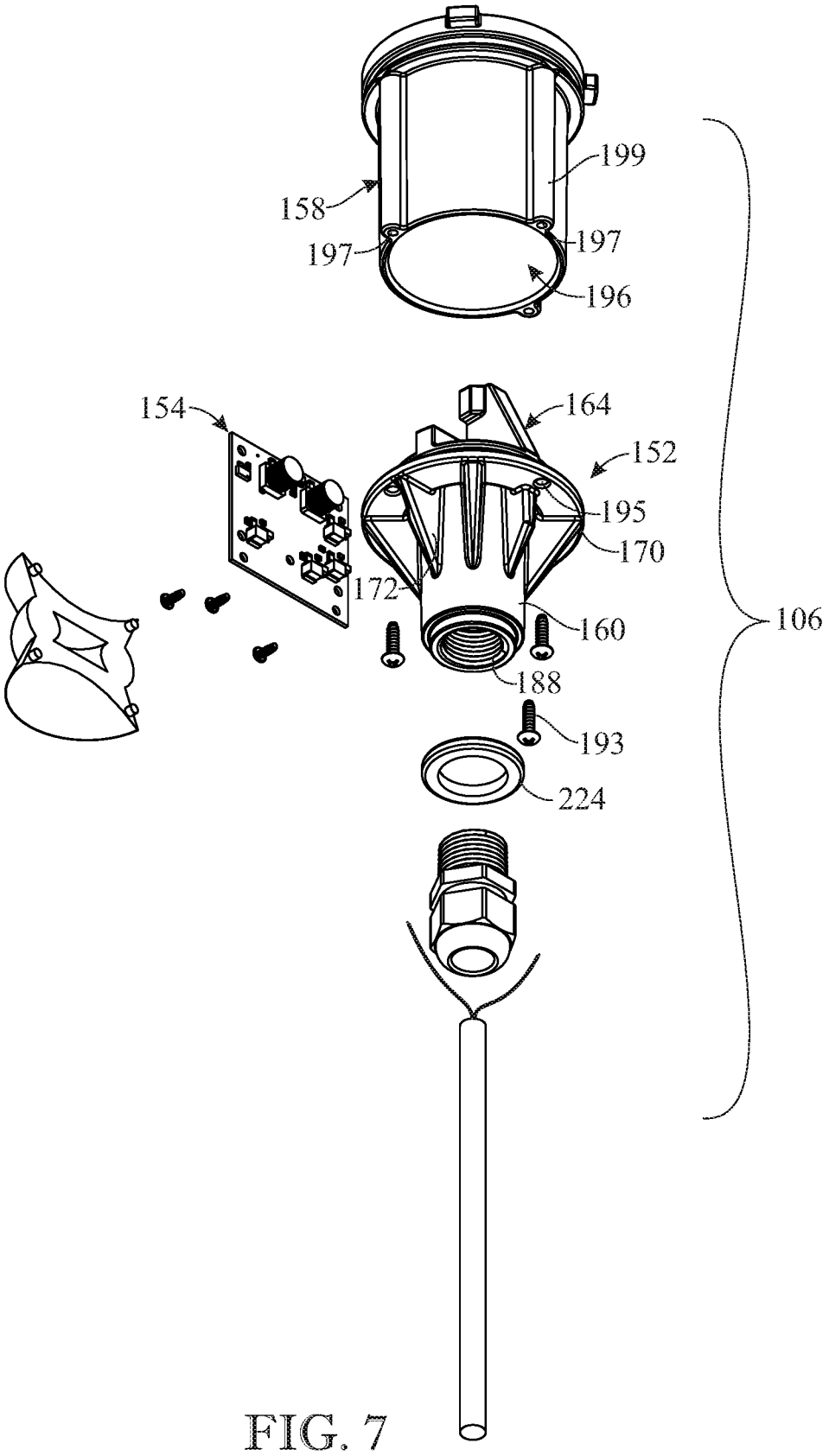
FIG. 7 presents a bottom rear exploded isometric view of the module on the same reduced scale as that of FIG. 6.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIGS. 1-3. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-4, 8 and 9, there is illustrated an exemplary embodiment of an artificially-lighted waterfall fixture apparatus, generally designated 100, in accordance with the present invention. The artificially-lighted waterfall fixture apparatus 100 generally includes a fixture housing 102, an elongated baffle 104 and an artificial light-focusing module 106. The fixture housing 102 of the waterfall fixture apparatus 100 includes a lower housing part 108 and an upper housing part 110 that overlies the lower housing part. The lower and upper housing parts 108, 110, being made of a suitable conventional plastic material, are fabricated by employment of any one of a number of suitable conventional manufacturing techniques and permanently fitted together along their respective opposite side edges and rear edges by employment of suitable conventional assembly techniques. The assembled lower and upper housing parts 108, 110 define a water-distributing channel 112 and a passageway 114 extending forwardly from and in communication with the water-distributing channel. The passageway 114 receives a forward flow of water from the water-distributing channel 112 that, after flowing through the passageway, produces an artificial waterfall 250 (see FIGS. 12 and 13) flowing from an outlet 116 of the passageway.

More particularly, the lower housing part 108 of the fixture housing 102 forms an elongated reservoir 118, a bottom panel 120, an annular sleeve 122 and a hollow inlet 124. The elongated reservoir 118 of the lower housing part 108 defines the water-distributing channel 112 for enabling lateral distribution of water therein. The bottom panel 120 of the lower housing part 108 is of a planar configuration and connects to and extends forwardly from a front portion 126 of the elongated reservoir 118. The front portion 126 of the elongated reservoir 118 has an arcuate configuration that curves upward and forward so as to accommodate (not disrupt or disturb) the forward laminar flow of water from the water-distributing channel 112 of the elongated reservoir 118 to the passageway 114. The annular sleeve 122 of the lower housing part 108 is centrally disposed and connected within the elongated reservoir 118. The annular sleeve 122 defines an orifice 128 that extends through the annular sleeve between and open at its opposite upper and lower ends 130, 132. The hollow inlet 124 of the lower housing part 108 is connected to the elongated reservoir 118, and in communication with the water-distributing channel 112 thereof, for enabling entry of a continuous supply of water into the elongated reservoir via the hollow inlet.

The upper housing part 110 of the fixture housing 102 forms an elongated lid 134, a top panel 136 and an annular collar 138. The elongated lid 134 of the upper housing part 110 overlies and is spaced above the elongated reservoir 118 of the lower housing part 108. The top panel 136 of the upper housing part 110 is of a planar configuration and is connected to and extends forwardly from the elongated lid 134. The top panel 136 overlies the bottom panel 120 of the lower housing part 108 such that the top and bottom panels together define therebetween the passageway 114 extending forwardly from and in communication with the water-distributing channel 112 of the elongated reservoir 118 of the lower housing part 108 that receives the forward flow of water from the water-distributing channel through the passageway and produces the artificial waterfall 250 flowing from the outlet 116 of the passageway. The annular collar 138 of the upper housing part 110 is connected to and extends above the elongated lid 134. The annular collar 138 is spaced above the annular sleeve 122 of the lower housing part 108 and defines an opening 140 in vertical alignment with the orifice 128 of the annular sleeve of the lower housing part.

Turning now to FIGS. 3, 4, 10 and 11, there is illustrated the elongated baffle 104 of the waterfall fixture apparatus 100. The elongated baffle 104 has a relatively rigid structure and is removably disposed in the fixture housing 102 along a top portion 142 of the elongated reservoir 118. A pair of spaced apart ledges 144 are formed at the top portion 142 on which the elongated baffle 104 is seated across the water-distributing channel 112. The elongated baffle 104, being made of a suitable conventional plastic or metal material, is fabricated by the employment of any one of a number of suitable conventional manufacturing techniques. The elongated baffle 104 has a multiplicity of apertures 146 provided in a plurality of arrays 148 serially arranged to form a row across the water-distributing channel 112. The multiplicity of apertures 146 of the elongated baffle receive the upward flow of water from the water-distributing channel 112, suppress any turbulence in the upward flow of water and convert the water into a forward laminar flow that travels through the passageway 114 of the fixture housing 102. The elongated baffle 104 also has a central opening 150 formed therein to accommodate the presence of the artificial light-focusing module 106, which will be described in detail hereafter, extending through the baffle 104.

Referring now to FIGS. 5-7, 10 and 11, there is illustrated an exemplary embodiment of the artificial light-focusing module 106 in accordance with further aspects of the present invention. The artificial light-focusing module 106 is supported centrally in the fixture housing 102 proximate the water-distributing channel 112 and aligned with the passageway 114 so as to generate a beam of light through the passageway 114 that produces a predetermined configuration of light in the forward laminar flow of water through the passageway and the artificial waterfall 250 flowing from the outlet 116 of the passageway. The artificial light-focusing module 106 is supported centrally in the fixture housing 102 by and between the annular sleeve 122 of the lower housing part 108 and the annular collar 138 of the upper housing part 110. The module 106 extends within and between the orifice 128 of the annular sleeve 122 and the opening 140 of the annular collar 138 proximate the water-distributing channel 112 and is aligned with the passageway 114 so as to generate the beam of light through the passageway that produces the predetermined configuration of light in conjunction with the laminar flow of water through the passageway. Furthermore, the module 106 is removable from and replaceable through the opening 140 of the annular collar 138 of the fixture housing 102 as will be described later below.

More particularly, artificial light-focusing module 106 generally includes a pedestal 152, a circuit board 154, a light source 156 and a tubular enclosure 158. The pedestal 152 of the module 106, being made of a suitable conventional plastic material, is fabricated by employment of any one of a number of suitable conventional manufacturing techniques. The pedestal 152 has a central tubular portion 160, an upper mounting portion 162, and an upright bracket 164. The upper mounting portion 162 of the pedestal 152 is connected on an upper end 166 of the central tubular portion 160. The upper mounting portion 162 forms a central platform 168, surrounding, and extending above and radially outward from, the upper end 166 of the central tubular portion 160. The upper mounting portion 162 also has an annular rim 170 formed by a peripheral recess made into the central platform 168. To reinforce the structural integrity of the pedestal 152, it may also includes a plurality of braces 172 spaced apart from one another, attached to and extending radially and at an angle outward from and upward along an upper segment of the central tubular portion 160 and connected to and underlying the periphery of the central platform 168. The upright bracket 164 is connected on and upstanding from a rear semi-circular segment 174 of the central platform 168. The upright bracket 164 has a front side 176 of a planar configuration facing outwardly away from the upright bracket toward the passageway 114 of the fixture housing 102.

The circuit board 154 of the module 106, being of a planar configuration, is fastened across the planar front side 176 of the upright bracket 164 by insertion of a plurality of screws 178 through a corresponding plurality of holes 180 in the circuit board and threading the screws 178 into a corresponding plurality of holes 182 tapped in the front side 176 of the upright bracket and aligned with the holes 180. The light source 156 of the module 106 is operatively mounted on the circuit board 154 so as to project the light beam outward therefrom. The light source 156 includes a light-generating device 184 in the form of a light-emitting diode (LED) mounted on the circuit board 154, and a light-focusing device 186 in the form of a light-focusing optic, which is fastened at its corners on the corners of the circuit board so as to overlie the light-generating device 184. The light-focusing optic 186 has a semi-annular rounded exterior shape to form the light beam in the predetermined configuration. The central tubular portion 160 of the pedestal 152 at a lower end portion 188 is internally threaded to adapt it to be threadingly-connected to a fitting 190 of a cable 192 to supply electrical power via electrical wires 194 to the circuit board 154. The electronics of the circuit board 154 may communicate.

The tubular enclosure 158 of the module 106 has a central cylindrical cavity 196 open at top and bottom so as to enable its placement over the upright bracket 164 and the light source 156 with the tubular enclosure seated at its bottom upon the annular rim 170 of the central platform 168 of the upper mounting portion 162 of the pedestal 152. The tubular enclosure 158 is fastened on the annular rim 170 of the central platform 168 by insertion of a plurality of screws 193 through a corresponding plurality of holes 195 in the annular rim 170 and threading the screws 193 into a corresponding plurality of holes 197 tapped in the bottoms of spaced apart vertical lugs 199 on the tubular enclosure 158 and aligned with the holes 193 of the annular rim 160. The tubular enclosure 158 has a front section 198 made of a transparent material so as to enable passage therethrough of the light beam from the light source 156. Further, the tubular enclosure 158 at its top has a circular rim 200 with a plurality of spokes 202 angularly spaced apart, centrally intersecting one another and individually attached at their opposite ends of opposite locations on an interior surface 204 of the circular rim.

The tubular enclosure 158 also has a plurality of tabs 206 affixed at angularly-spaced locations on an exterior surface 208 of the circular rim 200 that protrude radially outward from the circular rim. The annular collar 138 of the upper housing part 110, which defines the opening 140 in vertical alignment with the orifice 128 of the annular sleeve 122 of the lower housing part 108, includes a plurality of slots 210 recessed into and defined at angularly-spaced locations on an inwardly-protruding annular bottom end portion 212 of the annular collar. The number of tabs 206 and slots 210 are the same. Each slot 210 has an L-shaped configuration so as to provide a horizontal portion 214 and a vertical portion 216 intersecting with the horizontal portion at one end thereof. The vertical portion 216 of each slot 210 is open at the top of the inwardly-protruding annular bottom end portion 212 of the annular collar 138. At completion of insertion the module 106 into the fixture housing 102, the plurality of tabs 206 protruding outward at the top of the tubular enclosure 158 of the module may be aligned with and inserted into the vertical portions 216 of the slots 210 and then the module turned a short clockwise distance, as viewed in FIG. 2, to frictionally interfit the tabs 206 in the horizontal portions 214 of the slots 210 to secure the module 106 in the fixture housing 102. The order of the steps may be reversed to remove the module 106 from the fixture housing 102 upwardly through the annular collar 138. An aperture 217 is formed at the intersection of the spokes 202 to receive the head of a tool (not shown) to use to turn the module 106 relative to the slots 210 to install or release the module 106 into or from the fixture housing 102.

Also, the circular rim 200 of the tubular enclosure 158 and the lower end portion 188 of the pedestal central tubular portion 160 have respective recessed upper and lower grooves 218, 220 defined therein. Annular-shaped upper and lower seals 222, 224, made of a suitable resiliently yieldable material, are received in and protrude radially outward from the recessed upper and lower grooves 218, 220 so as to prevent entry of water past the upper and lower seals 222, 224 into the interior of the tubular enclosure 158 and the central opening of the pedestal 152 so as to thereby protect the circuit board 154, the light source 156 and the electrical wires 194 from contact by water. The exterior of portions of the pedestal 152 between the upper and lower seals 222, 224 may contact water and thus serves as a heat sink that will dissipate heat into the water and thus provide cooling of the electronics of the circuit board 154 and the light source 156 protected within the tubular enclosure 158 from contact with water. The thermal exchange between water and the light-focusing module allows for the light source 156 within the light-focusing module 106 to be driven at a much higher electrical current in comparison to other conventional light modules. The increase in current flow permits for an increase in light output without the concern of overheating or otherwise damaging the internal components of the light-focusing module 106.

Figure 8:
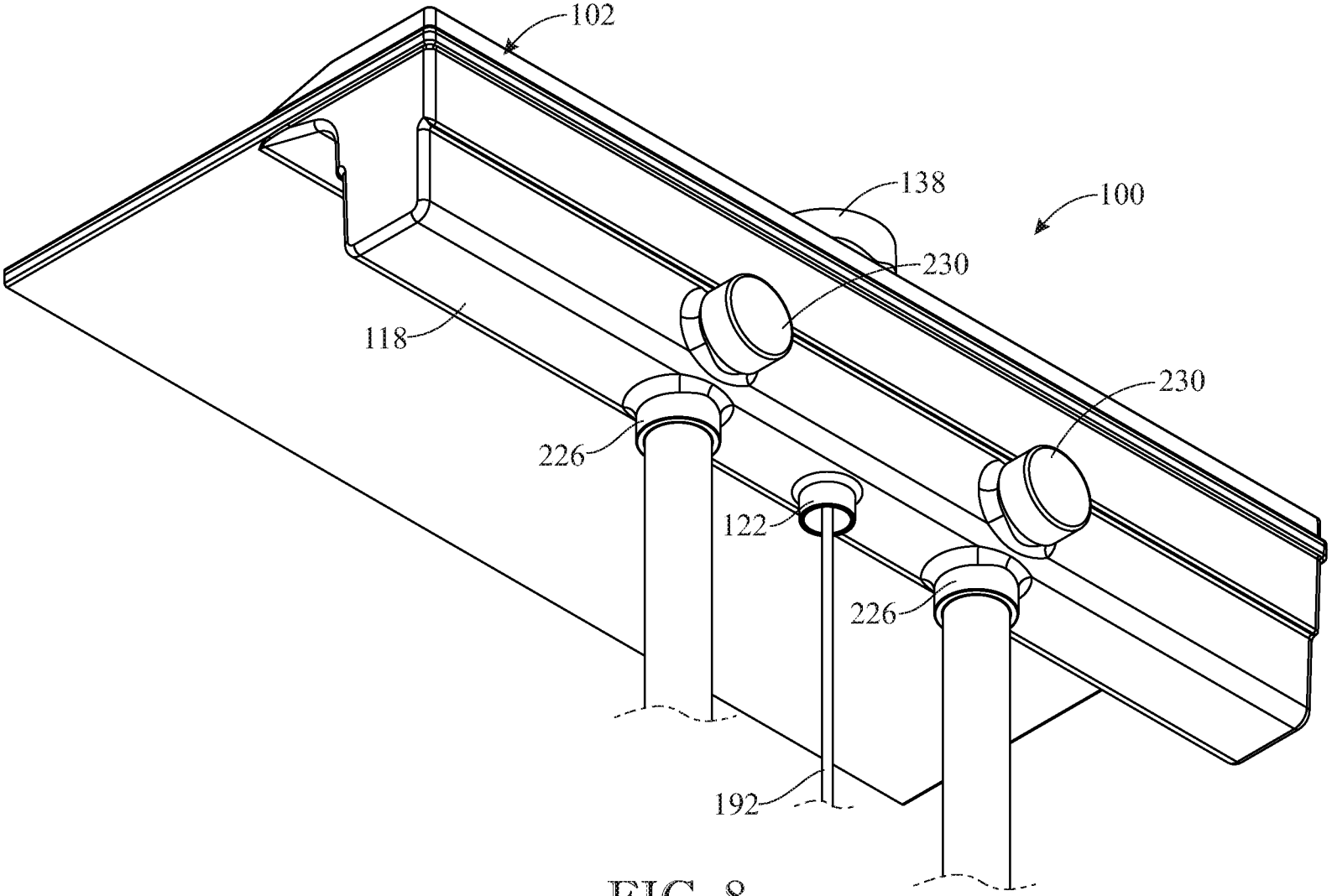
FIG. 8 presents an enlarged bottom rear isometric view of the apparatus originally introduced in FIG. 1, illustrating connection at the bottom of the apparatus to a water source.
Figure 9:
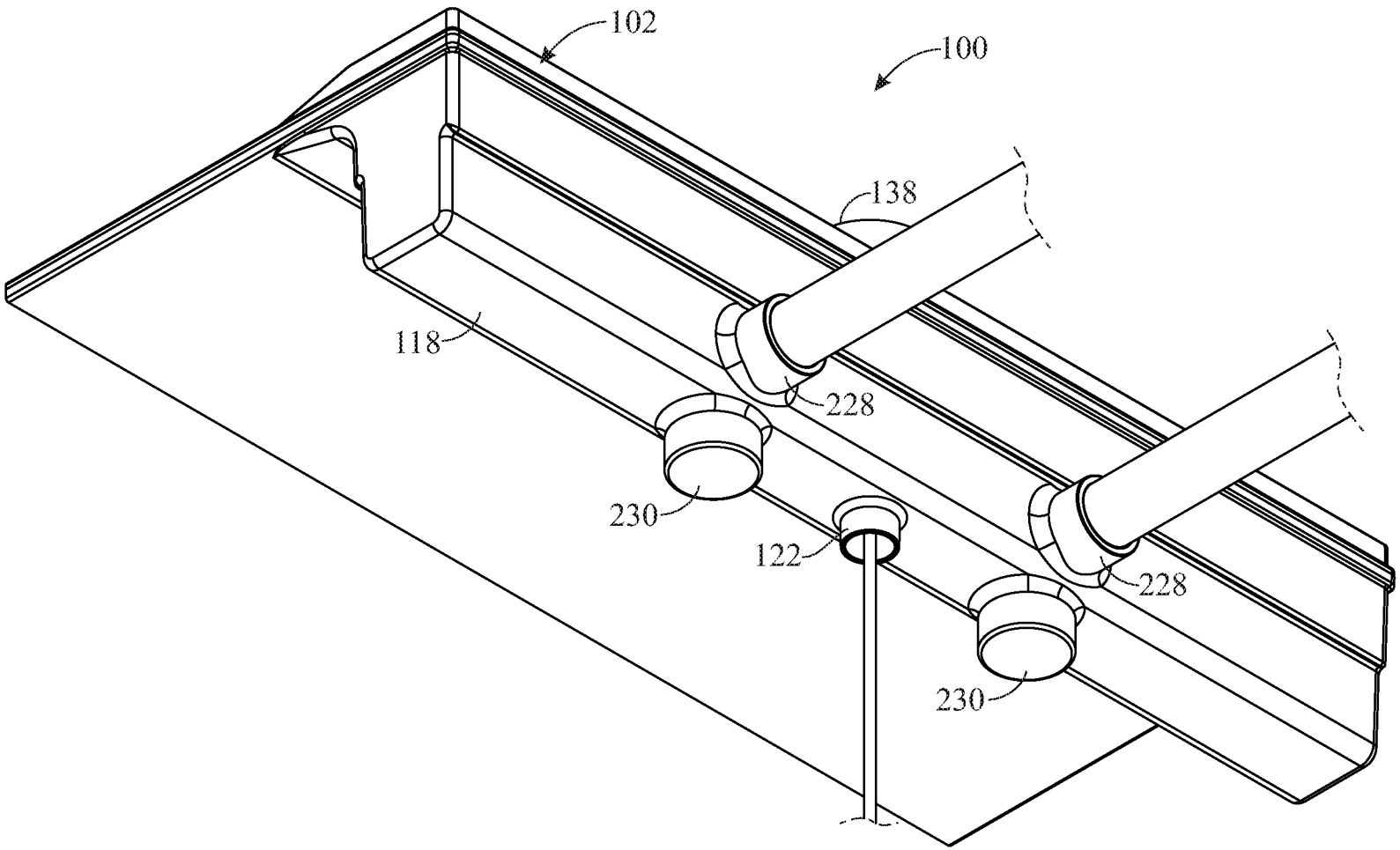
FIG. 9 presents another bottom rear isometric view of the apparatus on the same scale as that of FIG. 8, illustrating connection at the rear side of the apparatus to a water source.
Figure 10:
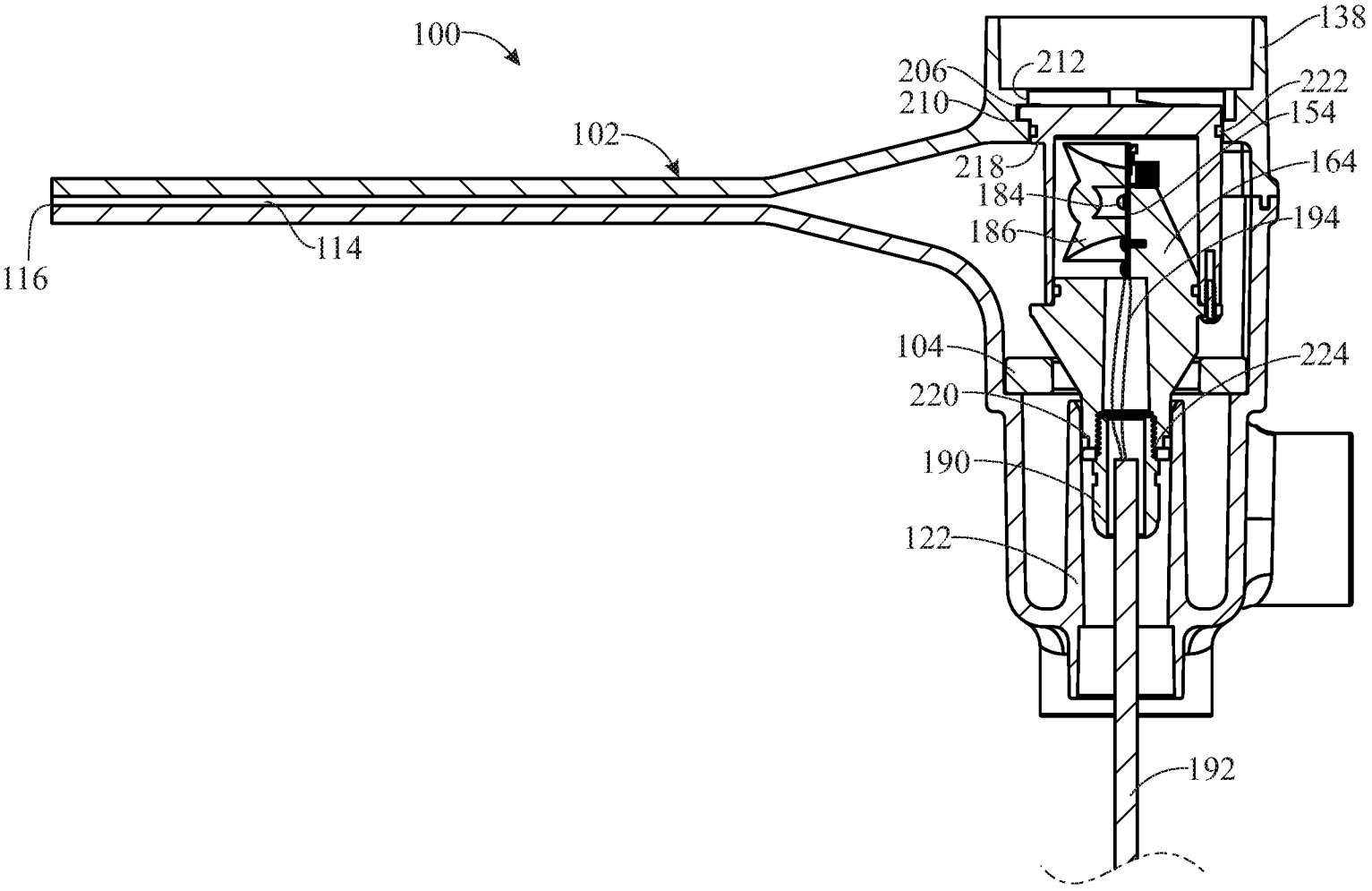
FIG. 10 presents an enlarged sectional view of the apparatus along section line 10-10 of FIG. 1.
Figure 11:
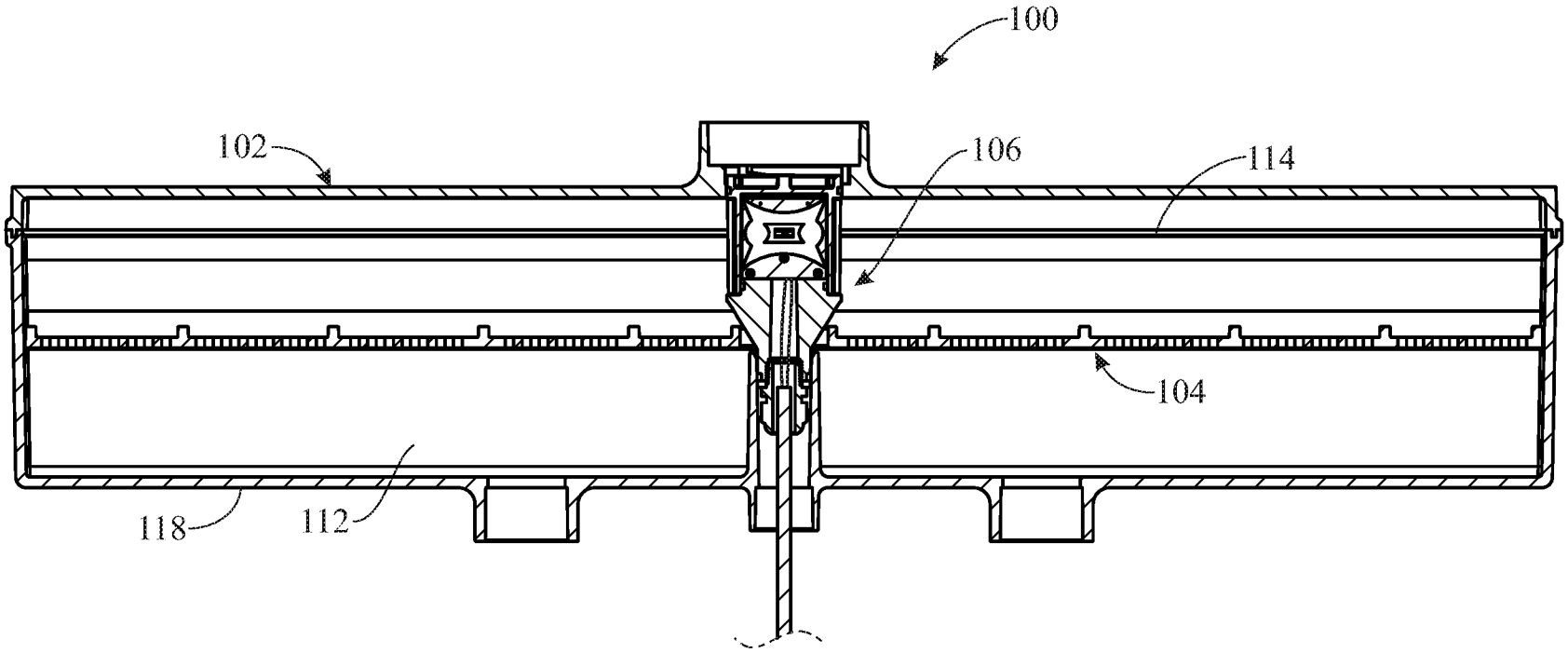
FIG. 11 presents an enlarged sectional view of the apparatus along section line 11-11 of FIG. 1 and orientated in a transverse relationship to the sectional view of FIG. 10.

Turning to FIGS. 4, 8, 9 and 11, there is illustrated bottom and rear pairs of inlet sleeves 226, 228 of the lower housing part 108 that may function as the hollow inlet 124 to the elongated reservoir 118, and in communication with the water-distributing channel 112 thereof, for enabling entry of the continuous supply of water into the elongated reservoir. As seen in FIGS. 8 and 9, the provision of the bottom and rear pairs of inlet sleeves 226, 228 enables one of the pairs to be selected for use and the other of the pairs closed off by installation of caps 230 over the selected pair of inlet sleeves.

Figure 12:
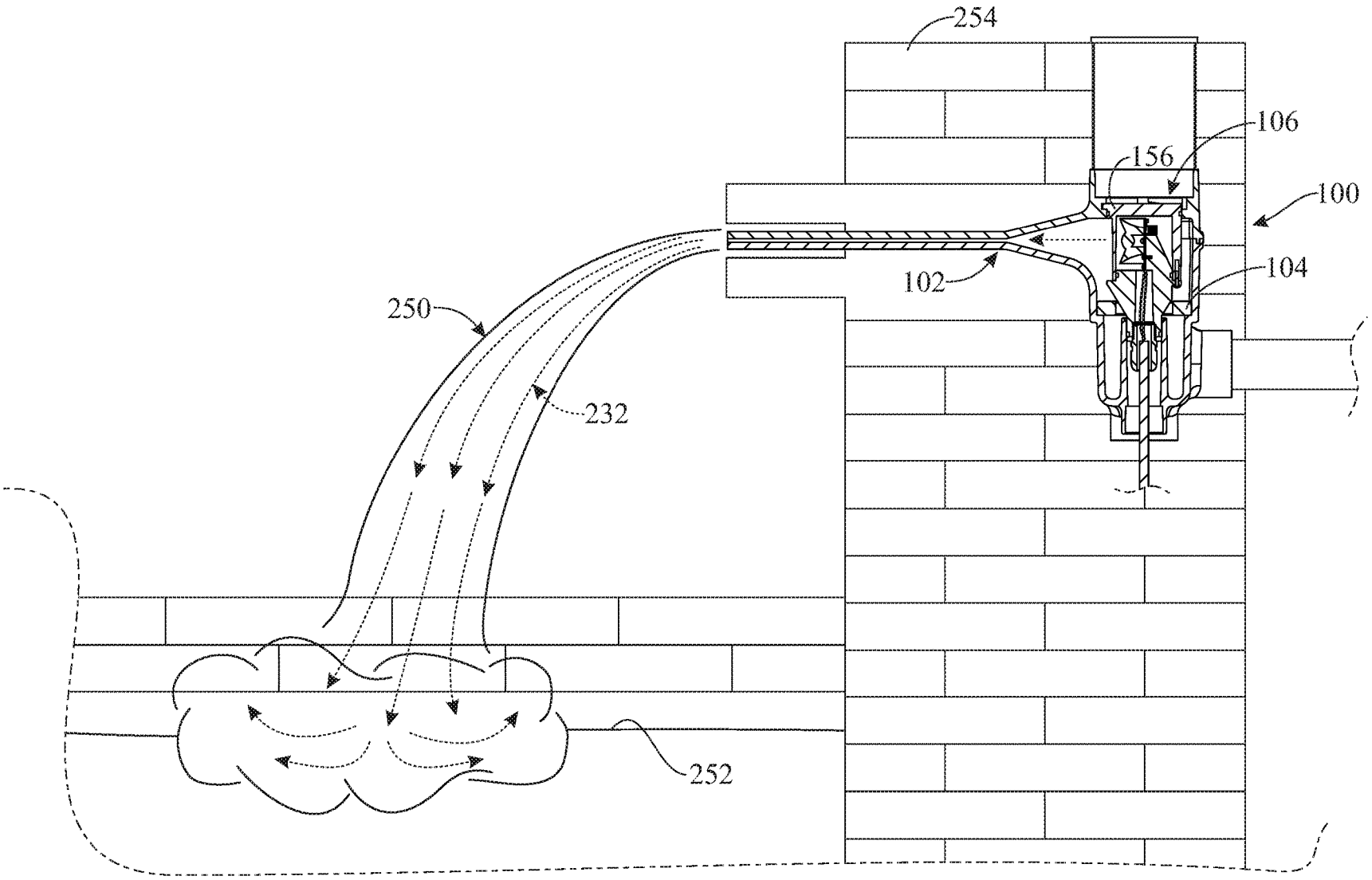
FIG. 12 presents a sectional view of the apparatus on a scale reduced from that of FIG. 10, illustrating a beam of light of a single color.
Figure 13:
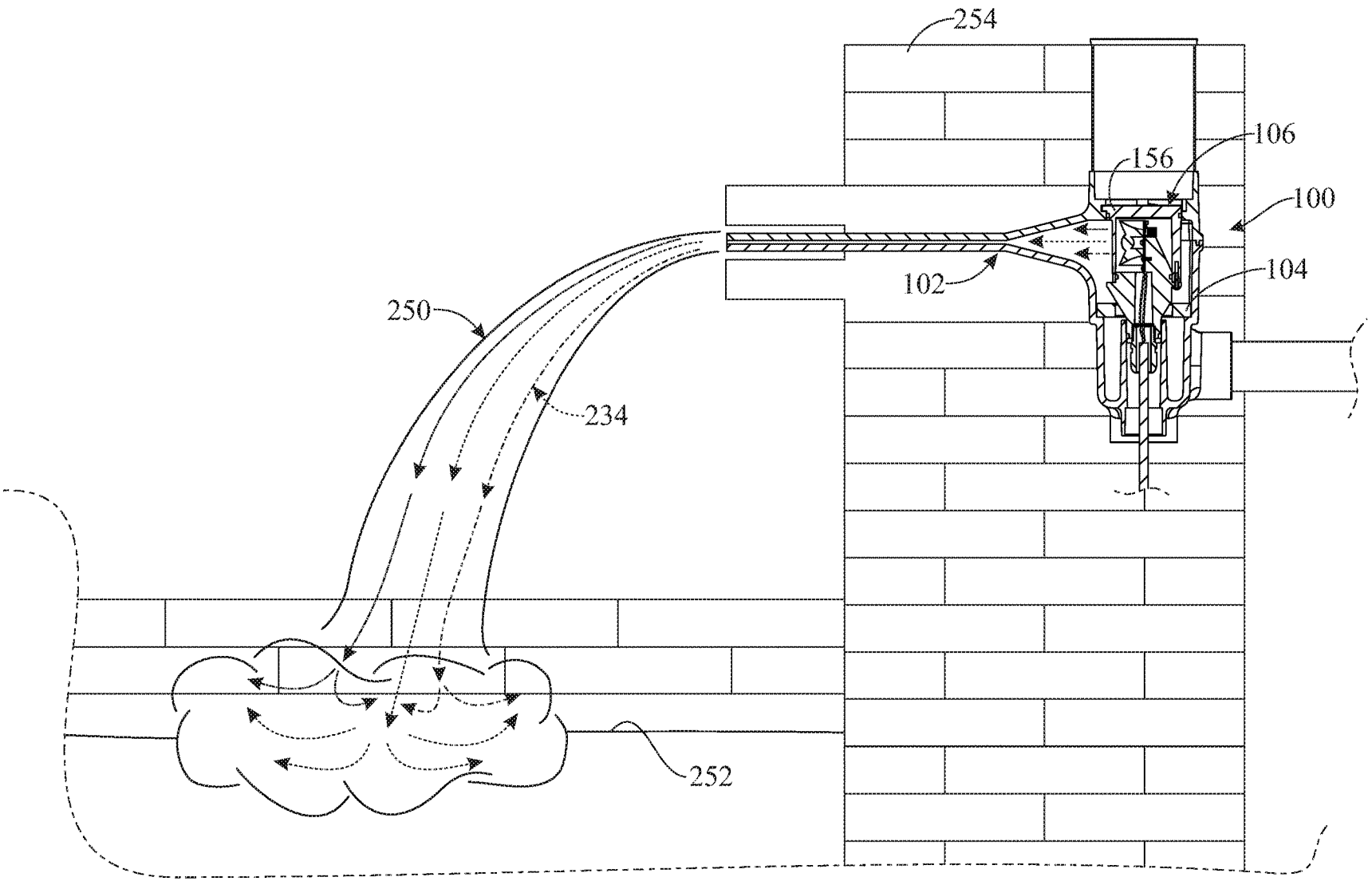
FIG. 13 presents another sectional view of the apparatus on the same scale as that of FIG. 12, illustrating beams of light of multiple colors.

Referring now to FIGS. 12 and 13, there is illustrated a simplified representation in the form of a light beam traveling totally and thus invisibly within the artificial waterfall 250 until it reaches the surface 252 of a pool of water that receives the waterfall where the light rays making up the light beam scatter and are then visible. In accordance with the principles of optical science what occurs at a boundary surface between different materials (here being water and atmosphere) having different indices of refraction is that the light rays in the waterfall 250 are totally internally reflected and thus stay within the waterfall 250 when the angle at which the light rays impinge at the boundary surface does not exceed a calculated critical angle based on the different indices of refraction. FIG. 12 represents a light beam 232 composed of light rays of a single color. FIG. 13 represents a light beam 234 composed of light rays of different colors. The electronics of the circuit board 154 may be programmable to emit one or more colors at the same time. The code used to program the light color is versatile and compatible with a plurality of code languages. The lighting can be controlled by an external controller (i.e. remote control) or a switch on a wall. As also seen in FIGS. 12 and 13, the apparatus 100 may be installed in a conventional manner on a suitable wall 254.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. An artificial light-focusing module, comprising:

a pedestal having a central tubular portion, an upper mounting portion connected on an upper end of said central tubular portion and having a central platform surrounding, and extending above and radially outward from, said upper end of said central tubular portion and an annular rim recessed into said central platform about a periphery thereof, and an upright bracket connected on and upstanding from a rear segment of said central platform and having a front side facing outwardly from said upright bracket;

a circuit board fastened across said front side of said upright bracket;

a light source operatively mounted on said circuit board so as to project a light beam outward therefrom in a predetermined configuration, said central tubular portion of said pedestal having a lower internally threaded end for connection with a cable to supply electrical power to said light source on said circuit board; and a tubular enclosure defining a central cavity open at least at a bottom of said tubular enclosure so as to enable placement of said tubular enclosure over said upright bracket and said light source and upon and attachment to said annular rim of said central platform of said upper mounting portion of said pedestal, said tubular enclosure having a front section made of a transparent material so as to enable passage therethrough of said light beam from said light source.

2. The module of claim 1 wherein the light source operatively mounted on said circuit board further comprises:

a light-emitting diode (LED); and a light-focusing optic fastened on said circuit board so as to overlie said LED.

* * * * *